US006019195A

United States Patent [19]

Pelofi

[11] Patent Number: 6,019,195

[45] Date of Patent: Feb. 1, 2000

[54] FALL PREVENTION DEVICE FOR VERTICAL CABLE

[75] Inventor: Pierre-Georges Pelofi, Bourges, France

[73] Assignee: Dalloz Fall Protection, Cedex, France

[21] Appl. No.: 09/339,900

[22] Filed: Jun. 25, 1999

[30] Foreign Application Priority Data

Jul. 3, 1998 [FR] France ..... 98 08548

[51] Int. Cl.[7] ..... A62B 1/20

[52] U.S. Cl. ..... 182/192; 182/193; 188/65.2

[58] Field of Search ..... 182/192, 193, 182/4, 5, 8; 188/65.3, 65.4, 65.5, 65.2, 65.1

[56] References Cited

U.S. PATENT DOCUMENTS 4,657,110 4/1987 Wolner ..... 182/5

5,156,240 10/1992 Ostrobrod ..... 188/65.1

5,265,696 11/1993 Casebolt ..... 182/8

5,323,873 6/1994 Pelofi ..... 182/4

5,638,919 6/1997 Pejout ..... 182/192

*Primary Examiner*—Alvin Chin-Shue

*Attorney, Agent, or Firm*—Greenblum & Bernstein, P.L.C.

[57] ABSTRACT

A fall prevention device for a vertical cable includes a body with a gutter for guiding the cable. The body supports a pin on which is articulated a lever one end of which ends in a cam which can clamp the cable against the bottom of the gutter and the other end of which is fastened to a ring. The cam is spring-loaded against the cable. A knurled wheel cooperating at all times with the cable rotates on a pin above the articulation axis of the lever. The ring has lateral teeth and is mounted to pivot on the lever so that, when the ring is pushed, the teeth can be caused to engage with the knurled wheel.

6 Claims, 3 Drawing Sheets

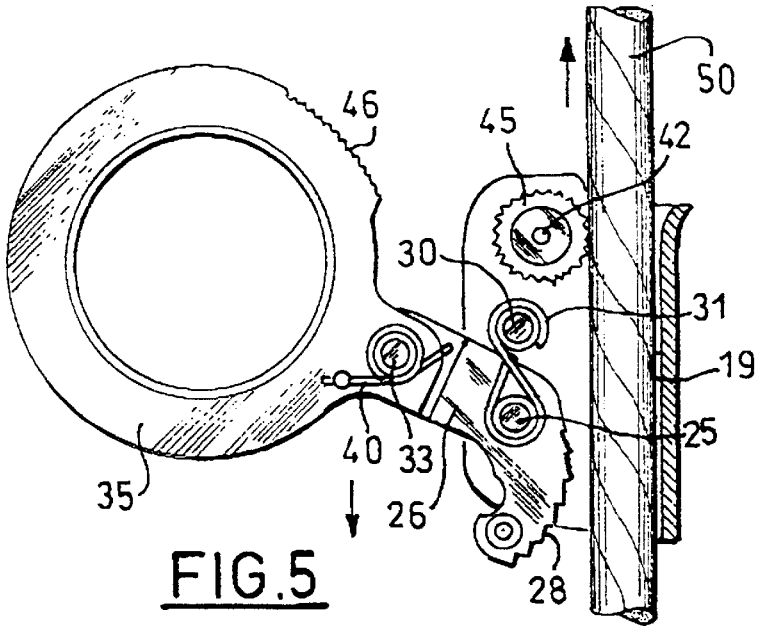
FIG.5
FIG.6
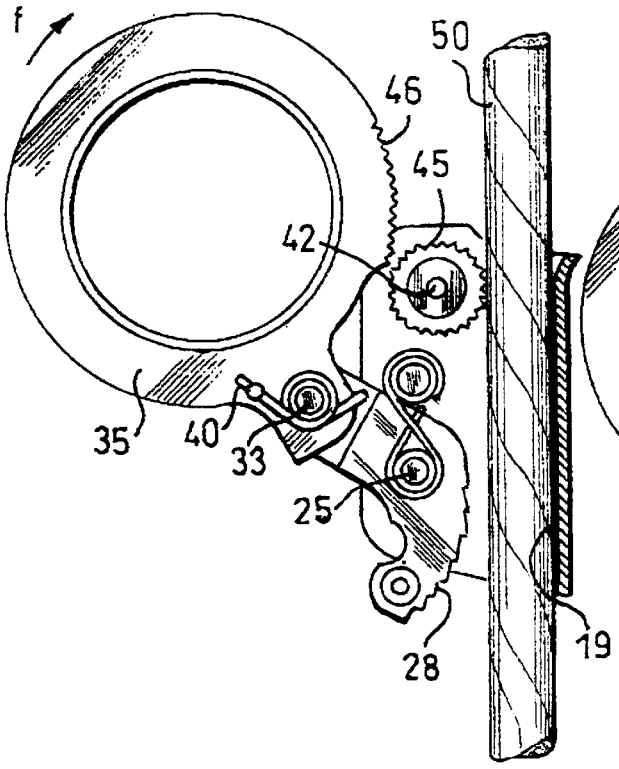
FIG.7
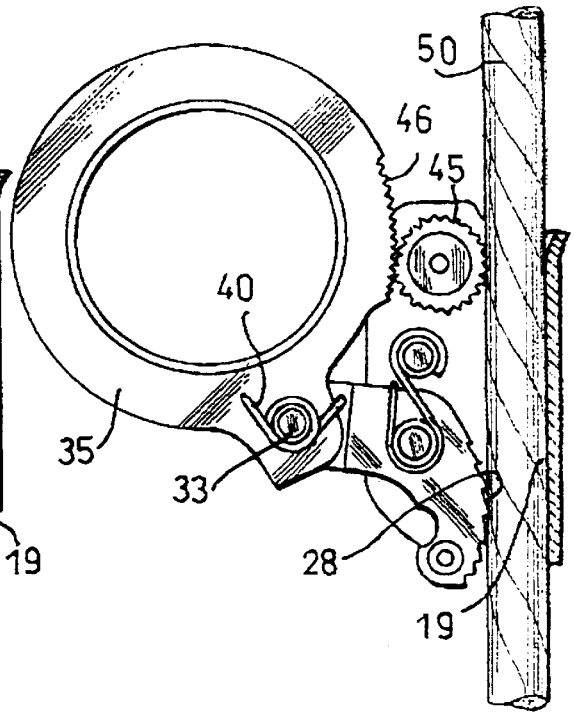

FALL PREVENTION DEVICE FOR VERTICAL CABLE

BACKGROUND OF THE INVENTION

1. Field of the Invention

The invention relates to a fall prevention device for a vertical cable.

2. Description of the Prior Art

The invention relates to a device comprising a body with a gutter through which the vertical cable passes, a lever articulated to the body and having a cam at one end and a ring at the other end designed to be connected by a link to a harness worn by a user, and a spring for pivoting the lever in one direction to wedge the cable between the cam and the bottom of the gutter.

Accordingly, should the user fall, the device is ready to damp the fall.

However, in many cases, the user must be able to move vertically and, because the device is pre-locked to the cable as a safety measure, it must be possible to release the device from the cable; the user therefore pivots the lever by pulling on the ring, against the action of the spring means, to separate the cam from the cable.

It has been found that this can be dangerous because, if the user makes a wrong move and falls, the first reflex is to push on the ring, which unlocks the device, although the device functions perfectly if the ring is released.

Accordingly, if the user holds onto the ring, the device slides along the cable without being retained and there is nothing to prevent the user falling.

One aim of the present invention is to remedy this drawback.

SUMMARY OF THE INVENTION

The invention consists in a fall prevention device for a vertical cable, comprising a body with two flanges and a gutter for guiding the vertical cable, the flanges supporting a pin on which is articulated a lever one end of which ends in a cam adapted to clamp the cable against the bottom of the gutter and the other end of which is fastened to a ring intended to be connected by a link to a harness of a user, spring means being provided to press the cam against the cable, in which fall prevention device the flanges support a pin above the articulation axis of the lever and on which rotates a knurled wheel cooperating at all times with the cable, the ring comprising lateral teeth and being mounted to pivot on the lever so that, when the ring is pushed, the teeth can be caused to engage with the knurled wheel so that the lever pivots on its pin so that the cam clamps the cable against the bottom of the gutter.

By virtue of the above arrangement, in the event of a fall, and if the user pushes on the ring, the knurled wheel cooperates with the teeth and, because it is turning because the cable is sliding in the gutter, it causes the ring to pivot which pivots the lever on its pin to bring the cam into contact with the cable so that the latter is wedged against the bottom of the gutter. Clearly this arrangement is safe.

The ring is preferably mounted to pivot on the lever against the action of a return spring holding it in a radial position relative to the lever.

In accordance with one constructional detail, the flanges are connected by a spacer between the pin of the knurled wheel and the pivot pin of the lever and which constitutes an abutment limiting pivoting of the lever in the direction corresponding to separation of the cam from the cable.

In accordance with another constructional detail, the spring means pressing the cam against the cable comprise a torsion spring wound on the pivot pin of the lever and one end of which cooperates therewith, whereas the other end abuts on the spacer.

In accordance with a further constructional detail, the end of the lever opposite the cam terminates in a yoke through which passes the pivot pin of the ring, a torsion spring on said pin cooperating with the ring at one end and with the lever at the other end.

In accordance with a final constructional detail, the knurled wheel is mounted with some play on its pin, a coil spring being inserted between the pin and the knurled wheel.

The invention will now be described in more detail, by way of example only and with reference to one particular embodiment shown in the accompanying drawings.

BRIEF DESCRIPTION OF THE DRAWINGS

FIGS. 5, 6 and 7 are diagrammatic sectional views showing how the device works.

DETAILED DESCRIPTION OF THE PREFERRED EMBODIMENT

Figure 1:
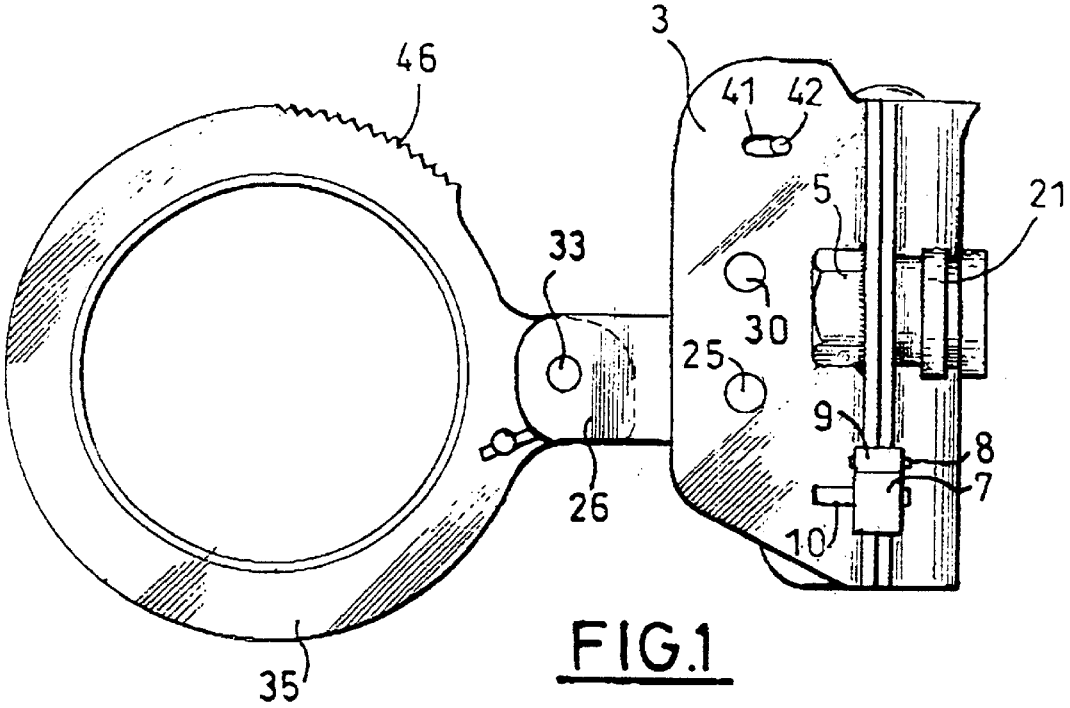
FIG. 1 is a general elevation view of the device of the invention.
Figure 2:
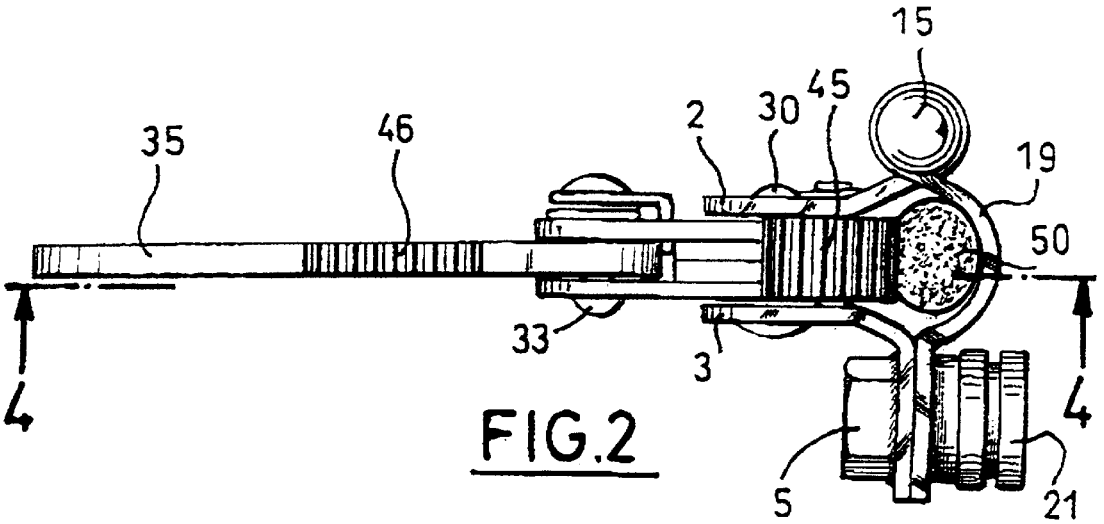
FIG. 2 is a plan view of the device from FIG. 1.
Figure 3:
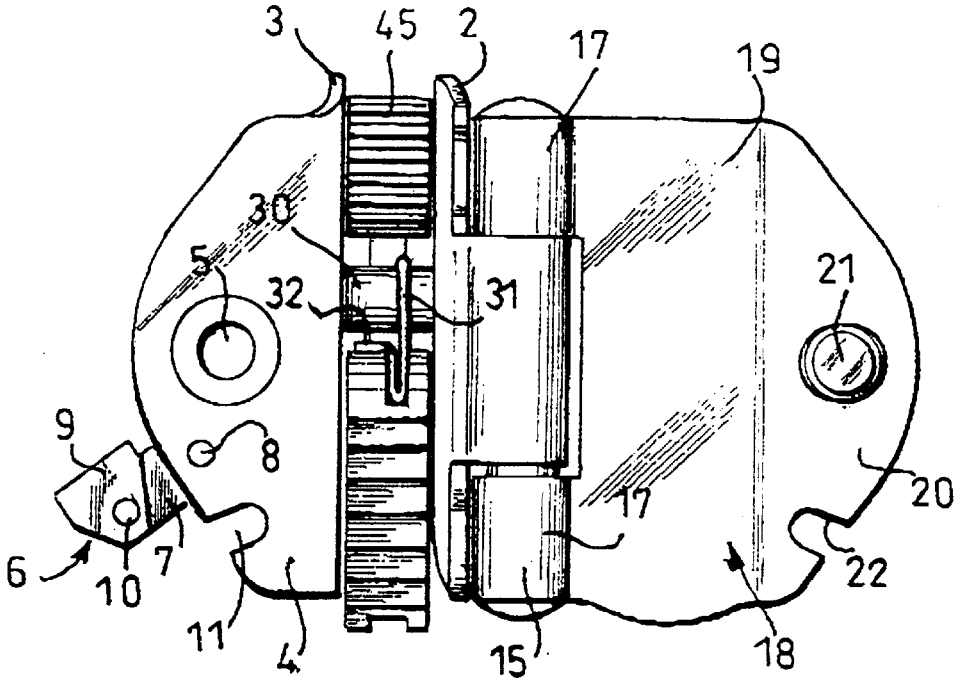
FIG. 3 is a front elevation view with the device open.

The fall prevention device for a vertical cable shown in the figures comprises a body 1 formed of two flanges 2 and 3, the flange 3 being extended by a cranked wing 4 to which a nut 5 is crimped.

A safety bolt 6 articulated to the edge of the extension 4 is formed by a lug 7 mounted to pivot on a pin a and terminating in a yoke 9 between whose branches extends a rod 10. A notch 11 in the edge of the extension 4 receives the rod 10.

The flange 3 is extended by a tubular member 14 through which passes a pin 15 which also passes through the tubular members 17 of a flap 18.

The flap 18 includes a gutter 19 and its free end has a flat part 20 adapted to cooperate with the extension 4, the flat part 20 incorporates a captive screw 21 designed to cooperate with the nut 5 to fix the flap 18 and the flat part 20 includes a notch 22 corresponding to the notch 11.

The two flanges 2 and 3 are linked by a pin 25 on which is articulated a lever 26 one end of which forms a cam 28 with teeth 29.

The flanges 2 and 3 are also linked by a spacer 30 onto which is wound one end of a spring 31 wound on the pin 25 and whose free end 32 cooperates with the lever 26 to cause it to pivot so that the cam engages in the gutter 19. The spacer 30 also constitutes an abutment limiting pivoting of the lever 26 in a direction corresponding to separation of the cam 28 from the gutter 19.

At its free end opposite the cam 28 the lever 26 forms a yoke through which passes a pin 33 on which is articulated a radial lug 36 of a ring 35.

The lug 36 has a heel 37 at the bottom end which bears against an abutment 38. A torsion spring 40 is engaged on the pin 33 and has one end fixed to the lever 26 and the other end fastened to the lug 36.

Figure 4:
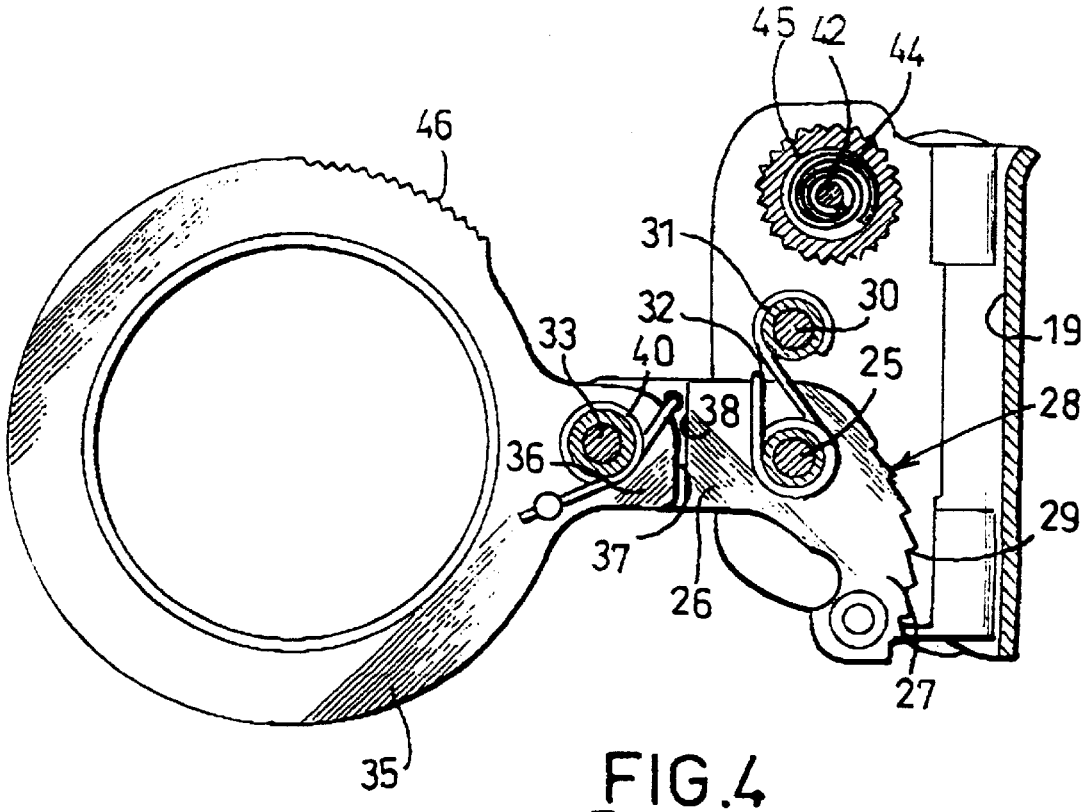
FIG. 4 is a view in section taken along the line 4—4 in FIG. 2.

In this way the ring 35 is held in a radial position relative to the lever 26 but can pivot in the direction of the arrow f (see FIG. 4) against the action of the spring 40.

There is an oblong opening 41 in each of the flanges 2 and 3, through which passes a pin 42 on which is wound a spring 44 on which a knurled wheel 45 is mounted. The spring provides a small degree of play of the knurled wheel on its pin.

Part of the lateral surface of the ring 35 includes teeth 46.

The device operates as follows:

The device is intended to be used with a taut vertical cable and is placed thereon after opening the flap 18 so that the cable 50 enters the gutter 19. A link fixed to the ring 35 is connected to a harness worn by the user.

The spring 31 presses the teeth 29 of the cam 28 onto the cable 50 with the result that the device is normally locked onto the cable.

Because the user must be able to ascend and descend, the ring 35 and the lever 26 can be pivoted against the action of the spring 31 to separate the cam 28 from the cable 50.

The device can then be moved freely along the cable 50.

The knurled wheel 45 cooperates with the cable at all times and therefore turns one way or the other when the device is moved along the cable 50.

If the user stops to work at a particular location, the ring 35 is released so that the teeth 29 of the cam 28 are engaged with the cable so that if the user should fall the device remains locked to the cable 50.

On the other hand, if the user ascends or descends, he pulls on the ring 35 to release the cable 50. If he makes a wrong move at this time and falls, he could fall along the cable because the device is no longer engaged with it. It has been found that in this situation the first reaction of the user is to push on the ring 35 so that it pivots in the direction of the arrow f (see FIG. 6), in which case its teeth 46 cooperate with the knurled wheel 45. Because the latter is driven in rotation because it cooperates with the cable 50, the ring 35 is pushed downward and the cam 28 is pressed against the cable 50 to lock the device.

Of course, the invention is not limited to the embodiment described and shown. Many modifications of detail can be made to it without departing from the scope of the invention.

There is claimed:

1. A fall prevention device for a vertical cable, of the type comprising a body with two flanges and a gutter for guiding said vertical cable, said flanges supporting a pin on which is articulated a lever one end of which ends in a cam adapted to clamp said cable against the bottom of said gutter and the other end of which is fastened to a ring intended to be connected by a link to a harness of a user, spring means being provided to press said cam against said cable, in which fall prevention device said flanges support a pin above the articulation axis of said lever and on which rotates a knurled wheel cooperating at all times with said cable, said ring comprising lateral teeth and being mounted to pivot on said lever so that, when said ring is pushed, said teeth can be caused to engage with said knurled wheel so that said lever pivots on its pin so that said cam clamps said cable against said bottom of said gutter.

2. The fall prevention device for a vertical cable claimed in claim 1 wherein said ring is mounted to pivot on said lever against the action of a return spring maintaining it in a radial position relative to said lever.

3. The fall prevention device for a vertical cable claimed in claim 1 wherein said flanges are connected by a spacer between said pin of said knurled wheel and said pivot pin of said lever and which constitutes an abutment limiting pivoting of said lever in the direction corresponding to separation of said cam from said cable.

4. The fall prevention device for a vertical cable claimed in claim 1 wherein said flanges are connected by a spacer between said pin of said knurled wheel and said pivot pin of said lever and which constitutes an abutment limiting pivoting of said lever in the direction corresponding to separation of said cam from said cable and said spring means pressing said cam against said cable comprise a torsion spring wound on said pivot pin of said lever and one end of which cooperates therewith, whereas the other end abuts on said spacer.

5. The fall prevention device for a vertical cable claimed in claim 1 wherein the end of said lever opposite said cam terminates in a yoke through which passes said pivot pin of said ring, a torsion spring on said pin cooperating with said ring at one end and with said lever at the other end.

6. The fall prevention device for a vertical cable claimed in claim 1 wherein said knurled wheel is mounted with some play on its pin, a coil spring being inserted between said pin and said knurled wheel.

* * * * *